US012584254B2

(12) United States Patent
Gardella et al.

(10) Patent No.: US 12,584,254 B2
(45) Date of Patent: Mar. 24, 2026

(54) NEEDLEPOINT FINISHING METHOD

(71) Applicants: Jo Ann Bridget Gardella, Norwalk, CT (US); John Louis Gardella, Norwalk, CT (US)

(72) Inventors: Jo Ann Bridget Gardella, Norwalk, CT (US); John Louis Gardella, Norwalk, CT (US)

( * ) Notice: Subject to any disclaimer, the term of this patent is extended or adjusted under 35 U.S.C. 154(b) by 0 days.

(21) Appl. No.: 19/230,540

(22) Filed: Jun. 6, 2025

(65) Prior Publication Data

US 2025/0297417 A1 Sep. 25, 2025

Related U.S. Application Data

(63) Continuation-in-part of application No. 18/592,600, filed on Mar. 1, 2024.

(60) Provisional application No. 63/543,111, filed on Oct. 9, 2023.

(51) Int. Cl.
*D05B 95/00* (2006.01)

(52) U.S. Cl.
CPC ..... *D05B 95/00* (2013.01); *D05D 2305/08* (2013.01)

(58) Field of Classification Search
CPC ..... D05B 95/00; D05D 2305/08
USPC ..... 40/1, 411, 768
See application file for complete search history.

(56) References Cited

U.S. PATENT DOCUMENTS

2002/0000058 A1* 1/2002 Chang ..... G09F 19/12 40/738

* cited by examiner

*Primary Examiner* — Justin V Lewis
(74) *Attorney, Agent, or Firm* — Neil D. Gershon

(57) ABSTRACT

A method for needlepoint finishing comprising trimming a canvas completed with a needlepoint stitched design leaving an edge portion spaced from a stitched area of the canvas to leave an unstitched area around at least a portion of a periphery of the canvas, cutting a non-paper based, substantially non-absorbent, rigid support to a desired size, wrapping a fabric composed of softer material than the rigid support around the support and attaching the fabric to the canvas. The rigid support restricts bending and prevents degradation of the rigid portion and mounted needlepoint canvas. A backing having at least one magnet can be provided to attach to the support.

18 Claims, 9 Drawing Sheets

NEEDLEPOINT FINISHING METHOD

This application is a continuation in part of application Ser. No. 18/592,600, filed Mar. 1, 2024, which claims priority from provisional application 63/543,111, filed Oct. 9, 2023. The entire contents of each of these applications are incorporated herein by reference.

BACKGROUND OF THE INVENTION

Field of the Invention

This application is directed to needlepoint finishing, and more particularly, to an improved system and method of needlepoint finishing.

Background

Current methods for needlepoint finishing utilize backings made from paper based products such as matboard, cardboard, foam board and the like. These finished products have several disadvantages. First, they lack full support due to their flexibility. Second, they suffer from degradation due to frequent bending, degradation due to humidity and can even get ruined if they get sufficiently wet by for example exposure to rain, condensation or snow. Thus, these finished products retain water which adversely affects the structure and integrity of the product.

It would be advantageous to provide a finishing system and method that overcomes the disadvantages of current needlepoint finishing techniques.

SUMMARY OF THE INVENTION

The present invention provides an improved technique/method/process for needlepoint finishing. The present invention also provides an improved mounted needlepoint canvas.

In general, needlepoint finishing involves taking a stitched canvas and turning it into a different functional or decorative finished product such as an ornament, patch or tag for clothing or bags, glass case, sign, etc. The present invention provides an enhanced/improved support for the finished product to prevent bending. The present invention also provides enhanced/improved support for the finished product to avoid the degradation problems discussed above.

In certain embodiments, the support includes a non-paper based product. That is, the support is not a foam, matboard, hardboard, cardboard, etc., as is currently used for the backing in current needlepoint finishing techniques. In some embodiments, the support of the present invention can be a rigid flat plastic material such as acrylic, PVC, polycarbonates, etc.

The paper based products currently used as backings are adversely affected by condensation and humidity, as their paper-based backing absorbs water, not just from rain but from humidity such as if placed in a humid environment. This retention of moisture wears the product and causes the paper-based board to swell and become moldy. They are also hard to dry, therefore further retaining moisture. As it harbors water, not only does the backing degrade but the needlepoint stitching can also degrade/lose its integrity as the fibers rot and lose their structure due to their contact with the moisture-retaining backing.

The present invention provides needlepoint finishing techniques that significantly reduce, if not eliminate altogether, the degradation of the support and needlepoint stitching. This is achieved through the non-absorbent rigid support which ensures moisture is not retained and maintains the integrity of the finished product. The rigid support also reduces the chances of degradation from excessive bending as in the current paper-based backings.

In accordance with one aspect of the present invention, a method for needlepoint finishing is provided comprising: a) trimming a canvas completed with a needlepoint stitched design leaving an edge portion spaced from a stitched area of the canvas to leave an unstitched area around at least a portion of a periphery of the canvas; b) cutting a non-paper based rigid support to a desired size, the size preferably being less than a size of the canvas; c) placing unstitched edges of the canvas underneath the canvas (i.e., tucking the canvas under itself around at least edges of the canvas) to substantially track a contour of the rigid support; d) placing a fabric composed of softer material than the rigid support over the rigid support; and e) attaching the fabric to one or both of the rigid support or the canvas, e.g., the stitched area and/or alternatively the unstitched area.

In some embodiments, the excess fabric is pulled tight around the support.

In some embodiments, the fabric is wrapped around at least an edge of the canvas.

In some embodiments, the outermost edge of the fabric and outermost edge of the canvas are sewn together along the outside, and in some embodiments, a cording can then be attached along the edge to provide a more finished look.

In some embodiments, the rigid support is composed of a non-absorbent material.

In some embodiments, the method further includes positioning a padding of softer material than the rigid support between the canvas, e.g., stitched area of the canvas, and the rigid support to capture the padding between the stitched area of the canvas and the rigid support.

In some embodiments, the rigid support is laser cut to the desired size.

In some embodiments, the method further includes attaching a cording positioned to hide a region where the fabric and canvas are joined.

In some embodiments, the method further includes forming at least one cutout (aperture) in the rigid support and placing a grommet in the at least one aperture to reinforce the aperture. In some embodiments, a ribbon is placed through the grommet.

In some embodiments, the method further includes placing at least one grommet in the fabric to prevent the fabric from fraying.

In accordance with another aspect of the present invention, a method for needlepoint finishing is provided comprising: a) trimming a canvas completed with a needlepoint stitched design leaving an edge portion spaced from a stitched area of the canvas to leave an unstitched area around at least a portion of a periphery of the canvas; b) cutting a non-paper based first rigid support to a desired size, the size preferably being less than a size of the canvas; c) wrapping the canvas around at least edges of the first rigid support to form a first multilayered piece comprising the canvas and first rigid support; d) wrapping a fabric around a second rigid support to form a second multilayered piece comprising the fabric and second rigid support, the fabric composed of softer material than the rigid support; e) placing the first and second multilayered pieces in apposition; and f) attaching the first and second multi-layered pieces such that the first and second rigid supports restrict bending of the canvas.

In some embodiments, the method further includes one or both of a) a first padding positioned in the first multilayered piece between the first rigid support and canvas and b) a second padding positioned in the second multilayered piece between the second rigid support and fabric.

In some embodiments, the method further includes attaching a cording positioned to hide a region where the fabric and canvas are joined.

In some embodiments, the first and second rigid supports are of different thicknesses and/or different sizes. In some embodiments, the rigid supports are composed of a non-absorbent material so as not to retain moisture.

In accordance with another aspect of the present invention a multilayered mounted needlepoint canvas is provided comprising a stitched needlepoint canvas having a front side and a back side and a first rigid support having a front side facing the canvas and an opposing back side, the first rigid support having a surface area in the front side less than a surface area of the front side of the canvas, wherein the first rigid support is formed from a non-paper based rigid material to restrict bending of the mounted canvas.

In some embodiments, a second canvas can be placed on the other side of the rigid support instead of the fabric.

In some embodiments, the first support is substantially planar.

In preferred embodiments, the first rigid support is composed of a non-absorbent material to prevent water retention and limit degradation of the mounted needlepoint canvas.

In some embodiments, the mounted needlepoint canvas further comprises a second rigid support. In some embodiments, the second support has one or both of a) a different thickness than a thickness of the first support or b) a different size than a size of the first support. In preferred embodiments, the second rigid support is composed of a non-absorbent material to prevent water retention and limit degradation of the mounted needlepoint canvas.

In some embodiments, unstitched edge regions of the canvas are wrapped around at least the edges of the first support.

In some embodiments, the mounted needlepoint canvas further comprises a padding positioned between the canvas and first support.

In some embodiments, the mounted needlepoint canvas further comprises a fabric positioned over the back side of the support, wherein edges of the fabric are wrapped around edges of the support.

In some embodiments, the mounted needlepoint canvas further comprises a cording positioned to hide a region where the fabric and canvas are joined.

In some embodiments, the mounted needlepoint canvas further comprises a first padding positioned between the canvas and first rigid support to form a first multilayered piece comprising the canvas, first padding and first rigid support, and a second padding positioned between a fabric and second rigid support to form a second multilayered piece, the fabric composed of softer material than the second rigid support, and the first and second multilayered pieces are attached.

In some embodiments, the rigid support(s) is composed of a material usable/suitable for outdoor use and/or for use in humid environments.

In accordance with another aspect of the present invention, a method for needlepoint finishing is provided comprising a) trimming a canvas completed with a needlepoint stitched design leaving an edge portion spaced from a stitched area of the canvas to leave an unstitched area around at least a portion of a periphery of the canvas; b) cutting a non-paper based rigid support to a desired size; c) securing a first magnet in or on the rigid support either before or after cutting the rigid support in step b; d) placing unstitched edges of the canvas underneath the canvas; e) wrapping a fabric composed of softer material than the rigid support around the support and f) attaching the fabric to one or both of the rigid support or the canvas.

In some embodiments, the method further comprises positioning a padding of softer material than the rigid support between the stitched area of the canvas and the rigid support to capture the padding between the stitched area of the canvas and the rigid support.

In some embodiments, the canvas is in the shape of a frame defining a periphery and an opening inside the periphery for viewing of a picture.

In some embodiments, a backing is provided having a second magnet, the second magnet of the backing in alignment with the first magnet of the support to attach the backing to the support. In some embodiments, the backing and the support each have multiple magnets, each of the multiple magnets of the backing in alignment with one of the magnets of the support. In alternate embodiments, the backing does not include a magnet but at least a portion of the backing is composed of a metallic material to provide magnetic attraction to secure the backing to the support via the first magnet. In alternate embodiments, the backing does not include a magnet but includes a metallic component such as a washer to secure the backing to the support via the magnetic attraction of the first magnet.

In some embodiments, a stand (foot) having a magnet is provided which is configured to attach to a metallic surface of the backing or align with a second magnet extending from or embedded in the backing to secure the stand to a rear portion of the backing.

In some embodiments, the rigid support is composed of a substantially non-absorbent material to limit retention of moisture and degradation of integrity of the rigid support and stitched canvas.

In accordance with another aspect of the present invention, a method for needlepoint finishing is provided comprising a) trimming a canvas completed with a needlepoint stitched design leaving an edge portion spaced from a stitched area of the canvas to leave an unstitched area around at least a portion of a periphery of the canvas; b) cutting a non-paper based first rigid support to a desired size; c) wrapping the canvas around at least edges of the first rigid support to form a first multilayered piece comprising the canvas and first rigid support; d) wrapping a fabric around a second rigid support to form a second multilayered piece comprising the fabric and second rigid support, the fabric composed of softer material than the first rigid support; e) placing the first and second multilayered pieces in apposition; and f) attaching the first and second multi-layered pieces such that the first and second rigid supports restrict bending of the canvas, wherein one or both of the first and second rigid supports includes a magnet.

In some embodiments, the method further includes providing one or both of a) a first padding positioned in the first multilayered piece between the first rigid support and canvas; and b) a second padding positioned in the second multilayered piece between the second rigid support and fabric.

In some embodiments, a backing is provided having a second magnet in alignment with the magnet of the first or second support to attach the backing to the first or second support.

In some embodiments, a stand is provided having a magnet configured to align with a metallic portion of the backing or align with the second magnet of the backing to secure the stand to a back portion of the backing.

In accordance with another aspect of the present invention, a multilayered mounted needlepoint canvas is provided comprising a) a stitched needlepoint canvas having a front side and a back side; and b) a first support having a front side facing the canvas and an opposing back side, the first support having a surface area in the front side less than a surface area of the front side of the canvas, wherein the first support has a first magnet.

In some embodiments, the support is formed from a non-paper based rigid material to restrict bending of the mounted canvas.

In some embodiments, the mounted needlepoint canvas further includes a padding positioned between the canvas and first support.

In some embodiments, the mounted needlepoint canvas further includes a backing having a second magnet, the second magnet of the backing in alignment with the first magnet of the first support to secure the backing to the support.

In some embodiments, the needlepoint canvas is in the shape of a picture frame, and a stand is provided having a magnet, the magnet of the stand configured to align with the second magnet of the backing or align with a magnet, external or embedded in the backing, to secure the stand to a back portion of the backing.

In some embodiments, the backing and the support each have multiple magnets, each of the multiple magnets of the backing in alignment with one of the magnets of the support.

BRIEF DESCRIPTION OF THE DRAWINGS

So that those having ordinary skill in the art to which the subject invention pertains will more readily understand how to use the technique and make and use the apparatus (device) disclosed herein, preferred embodiments thereof will be described in detail hereinbelow with reference to the drawings, wherein:

FIGS. 4-8 show a two-piece needlepoint finishing method/technique/process of the present invention wherein:

FIG. 4 shows a third step in the method (or a first step in the canvas mounting technique/post canvas preparation) wherein the stitched canvas is wrapped over the rigid support of the present invention forming a first multilayered piece with a padding between the rigid support and canvas;

FIG. 5 shows the back side of the rigid support and canvas of FIG. 4, portions of the non-stitched perimeter/area of the canvas extending over the support;

FIG. 6 shows a fourth step in the method wherein a fabric is wrapped over a second rigid support to form a second multilayered piece with a padding between the second support and fabric;

FIG. 7 shows the fifth step in the method wherein the first and second multilayered pieces of FIGS. 4 and 6 are attached together to form the finished product (multilayered mounted needlepoint canvas), the fabric forming the back surface/back end of the product;

FIG. 8 shows an optional sixth step of the addition of cording to the two pieces to hide the joining regions of the finished product;

FIGS. 9-10 show a one-piece needlepoint finishing method/technique/process of the present invention wherein:

FIG. 9 shows a third step in the method (or a first step in the canvas mounting technique/post canvas preparation) wherein the stitched canvas is wrapped over the rigid support at a front end and a fabric is wrapped over the support at the back (rear) end, and a padding is positioned between the support and canvas;

FIG. 10 shows an optional fourth step of the addition of the cording to the multilayered single piece of FIG. 8.

DETAILED DESCRIPTION OF PREFERRED EMBODIMENTS

The present invention is directed to an improved method (also referred to herein as a technique or process) for needlepoint finishing. The present invention provides a one piece as well as a two piece technique for product finishing, both of which are discussed below.

The present invention is also directed to a rigidly supported multilayered mounted needlepoint canvas, the multilayer formed by the methods/techniques/processes of the present invention.

Needlepoint is typically created by threads or yarn stitched on canvases typically having a flat mesh. The threads or yarn can include for example cotton, silk, wool, synthetic or linen fibers, that are threaded through openings/apertures in the canvas in a desired pattern.

When the stitched canvas is completed, it is desirable to finish the needlepoint by mounting the canvas to a backing/support to form it into a useful or decorative/ornamental item such as a sign, ornament, patch/tag for clothing or bags, glass case, picture on stand, panel (front, back and/or side) of a box, etc. As discussed above, current mounted needlepoint canvases suffer from several disadvantages, which are addressed and solved by the present invention.

Figure 1:
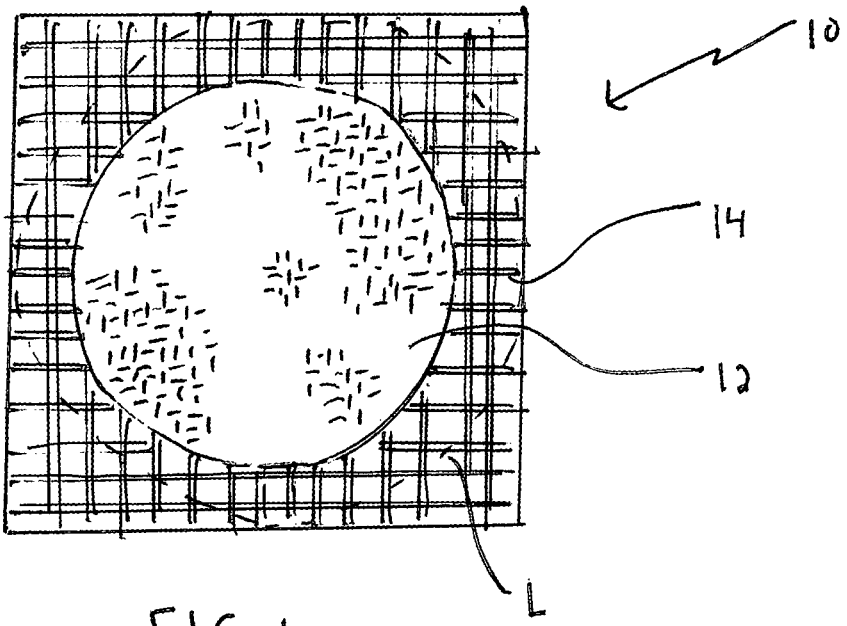
FIG. 1 shows a front view of a flat stitched canvas prior to commencement of the needlepoint finishing method/technique/process of the present invention, the drawings also showing in dashed lines the outline for trimming.
Figure 2:
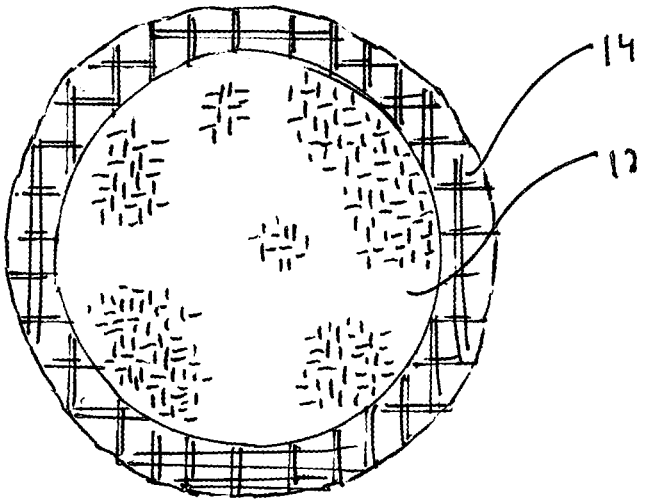
FIG. 2 shows a first step in the method wherein the portions of the non-stitched canvas are trimmed to the desired shape (e.g., a round shape), leaving non stitched portions around the perimeter of the stitched area, the trimming done along the dashed lines of FIG. 1.
Figure 3:
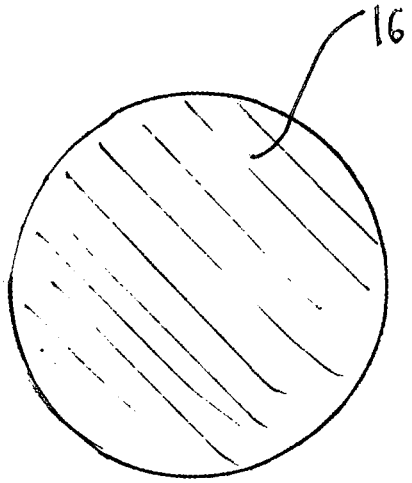
FIG. 3 shows a second step in the method wherein a rigid support is cut to an appropriate size and shape to conform or substantially conform to the stitched canvas.
Figure 7:
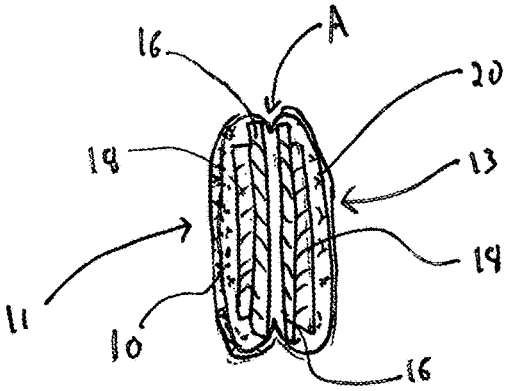
Figure 8:
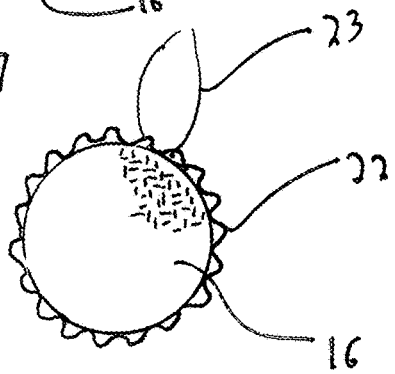
Figure 9:
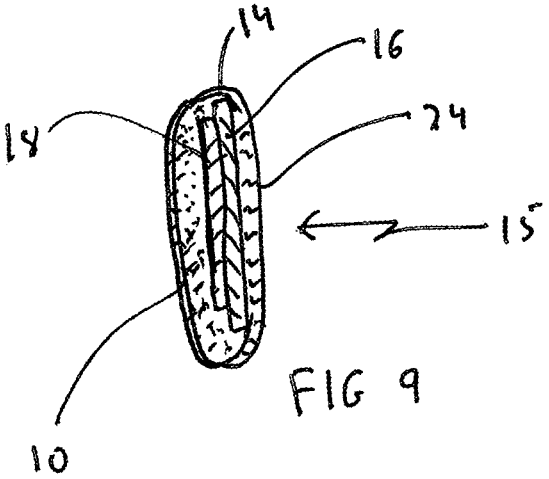
Figure 10:
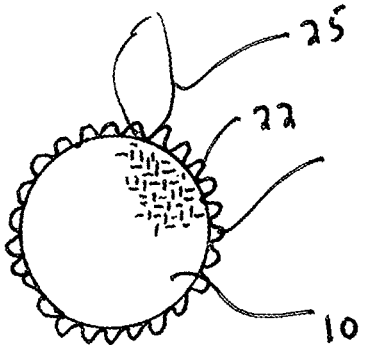
Figure 11:
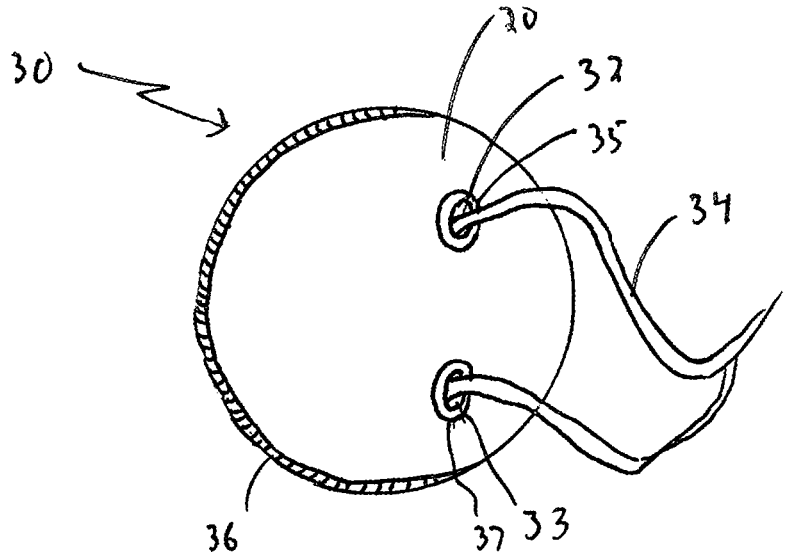
FIG. 11 shows an example of one rigidly supported finished product formed by the method of the present invention and having a ribbon extending through a pair of holes.
Figure 12:
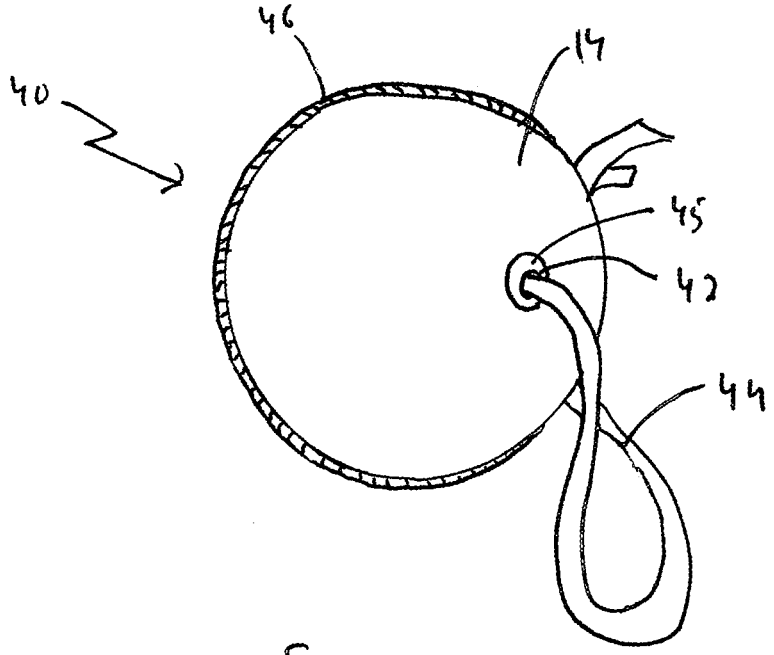
FIG. 12 shows an example of another rigidly supported finished product formed by the method of the present invention and having a ribbon extending through a single hole.

Referring now to the drawings and particular embodiments of the present disclosure, wherein like reference numerals identify similar structural features of the apparatus throughout the several views, FIGS. 1-3 illustrate the first steps in the needle point finishing process of the present invention to prepare the stitched canvas for mounting to the support (referred to herein as the canvas preparation), FIGS. 4-8 illustrate an embodiment of needle point finishing of the present invention in accordance with a two piece method, FIGS. 9-10 illustrate an embodiment of needlepoint finishing of the present invention in accordance with a one-piece method, and FIGS. 11 and 12 illustrate two examples of finished products.

As shown in FIG. 1, the stitched area 12 of the canvas 10 occupies less than the entire portion of the apertured canvas leaving unstitched areas around the perimeter. Reference numeral 14 designates the unstitched area of the canvas 10. Note the round shape of the stitched area 12 is one of the many shapes that can be formed in the canvas.

Once the stitching is complete and the needlepoint design is done as schematically illustrated in FIG. 1, the canvas 10 is trimmed around, but spaced from, the stitched area 12 to remove some or most of the unstitched (open) area 14 as shown in the first canvas preparation step of FIG. 2. Note the canvas 10 can be trimmed along the circular dashed line L of FIG. 1. Note the canvas 10 can be trimmed to a circular shape as shown to correspond to the stitched area 12 of the canvas 10. Note the stitched area and/or the resulting trimmed canvas can have shapes other than the circular shape as shown; the circular shape being illustrated by way of example. These shapes can be symmetric or asymmetric. As shown in FIG. 2, after trimming, there still remains an unstitched area 14 around the periphery of the stitched canvas, albeit smaller than the pre-trimmed area 14 of FIG. 1, to provide a sufficient amount of unstitched canvas for wrapping, tucking and/or attachment to the materials described below.

In the next step, the rigid support 16 of the present invention is cut to a desired size. Note the support 16 is made of a rigid material which is cut by laser cutting or other methods. This more rigid material provides more support than the conventionally currently used paper based products such as matboard, cardboard, foam board or the like. In the two piece embodiment, two supports 16 are cut to form the sandwich-like end product; in the one piece embodiment, only one support 16 is cut. Note each support can be one piece or two or more pieces. The supports can also be stacked to make one or two or more pieces of the same or different shapes and sizes. The rigid support is preferably made of a rigid flat plastic material such as acrylic, PVC, polycarbonates, etc.

The rigid support is preferably composed of a non-absorbent material which ensures moisture is not retained, thereby preventing damage to the support as well as the mounted canvas, and therefore maintains the integrity of the finished product. The rigid support also reduces the chances of degradation from excessive bending.

The rigid support provides a precision cut plastic form or purposely designed form of the desired shape. That is, the support in preferred embodiments is cut in a desired shape to correspond, e.g., match or conform, to a shape (contour) of the stitched canvas. However, the rigid support in alternate embodiments can be a different shape and/or a different size than the stitched canvas area.

Note the canvas is preferably trimmed to substantially track/substantially correspond, i.e., substantially follow the contour, of the rigid support, or alternatively, the rigid support is preferably trimmed to substantially track/substantially correspond, i.e., substantially follow the contour, of the canvas. In either case, the end result is the same as they are intended in preferred embodiments to substantially match.

The support can be specifically set up with offsets from the finished piece to achieve the optimal finished look. That is, the support can be sized in preferred embodiments to have a dimension, e.g., diameter, length, width, less than the dimension, e.g., diameter, length, width, of the canvas to provide a sufficient edge around its perimeter so the non-stitched area of the canvas can be tucked under itself in accordance with the methods disclosed herein.

The support is preferably planar or substantially planar. Two or more supports can be stacked or layered. Further, two or more supports can be of different thicknesses and/or different sizes, and/or one or more of the supports can have increased thicknesses in different areas, to provide different finished products with non-planar features.

Figure 4:
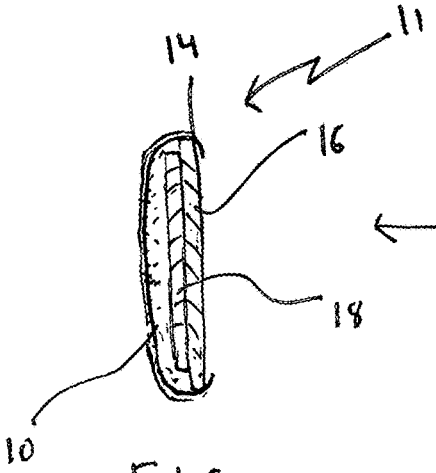
Figure 5:
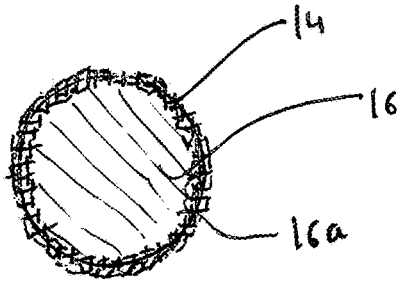

Turning now to the two piece method of FIGS. 4-8, in the third step of the process (also considered the first step in the post canvas preparation method or first step in the canvas mounting), as shown in FIG. 4, the unstitched edge regions/area 14 of the canvas 10 are wrapped around at least the edges of the support 16. A padding 18 is composed of a softer material than the support 12 and can be made of materials such as cotton, synthetics, etc. The padding 18 is positioned between the stitched area 12 of the canvas 10 and the support 16 and is captured between these two components. Thus, this first multilayered piece 11 comprises the canvas 10 as the outermost (and front) layer, the padding 18 as the intermediate layer and the support 16 as the innermost layer. The unstitched canvas region (area) 14 is shown wrapped around the back **16*a* of the support 16 as illustrated in FIG. 5. The unstitched canvas region 14 can be secured to the support 16 or alternatively can remain unattached and attached only to the fabric described in the next step below. Note the diameter (or length depending on the shape) of the padding 18 and support 16 can be the same or different, e.g., the support 16 can have a longer length than the padding 18 as shown in FIG. 4). The thicknesses of the padding 18 and support 16 can be similar or different. Note in alternate embodiments, the padding 18 is not provided and the piece 11 has only two layers—the canvas 10 and support layer 16. The padding 18** itself can be composed of different thicknesses to provide a different finished look.

Figure 6:
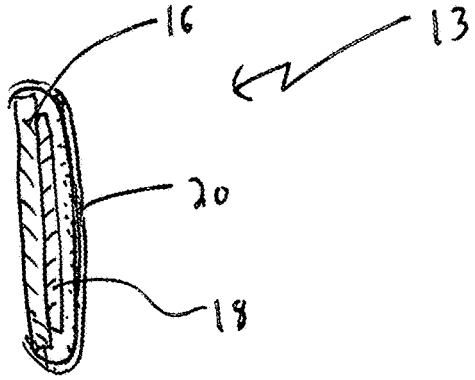

FIG. 6 shows the multilayered second piece 13 of the two piece embodiment which is configured for attachment to the first multilayered piece 11 to form the back of the finished product. Second piece 13 includes another (also referred to herein as "second") rigid support 16, another piece of padding 18 and a fabric 20. The fabric utilized can be of various materials such as cotton, silk, linen, synthetics, etc. The fabric 20 is of sufficient size (e.g., greater length/diameter than the support 16) so it is wrapped around at least the edges of the support 16. The fabric 20 is made of a softer material than the support 16 and can be secured to the support 16 or alternatively can remain unattached and attached only to the unstitched canvas region 14 as described in the next step below. Thus, this second multilayered piece 13 comprises fabric 20 as the outermost (and back) layer, the padding 18 as the intermediate layer and the support 16 as the innermost layer. Note in alternate embodiments, the padding 18 is not provided and the piece 13 has only two layers—the fabric layer 20 and support layer 16. The supports of the first and second pieces 11 and 13 can be of the same or different dimensions. The support of the second piece 13, like the support of piece 11, is preferably rigid and non-absorbent.

In the next step of FIG. 7, the pieces 11 and 13 are brought into apposition and are attached together along their edges, preferably by sewing, although other attachment methods, such as gluing around the perimeter are also contemplated. Thus, the finished mounted needlepoint canvas product comprises the following layers from front to back: stitched canvas 10, first (front) padding 18, first (front) support 16, second (back) support 16, second (back) padding 18 and fabric 20.

In the next optional step depicted in FIG. 8, a cording 22 can be added to hide the region where the two sides are joined to provide a smoother more finished look. The cording 22 can be placed in the region indicated by the arrow A in FIG. 7 and wrapped around the entire product. The cording can be attached by glue, by sewing onto the fabric 20 and canvas 10, or by other methods.

A ribbon, string, lace, etc. 23 can be formed by the cording itself (e.g., forming a loop in the cording) or alternatively a separate component attached to the cording 20 as shown in FIG. 8, in either case forming a loop for tying the finished product to another item such as a bag or backpack and/or for hanging the finished product. That is, it can comprise two free ends that are positioned around a handle or strap of an item and then the two ends are tied together to secure the finished product. The ribbon, string, etc. can alternatively be inserted through the support in the manner described below in conjunction with FIGS. 11 and 12. The ribbon, string, etc. can also extend through the grommet (described below).

FIGS. 9 and 10 illustrate an alternate embodiment of product finishing utilizing a one piece method. The method initially is the same as in FIGS. 1-3 with the canvas trimmed to the desired shape leaving the unstitched area region for attachment. In this one piece method, after the steps of FIGS. 1-3, in the third step of the process (also considered the first step in the post canvas preparation method or first step in the canvas mounting), the unstitched edge regions 14 of the canvas 10 are wrapped (folded) underneath (e.g., tucked under) the canvas 10 itself. A padding 18 is placed between the stitched area of the canvas 10 and the support 16 and is captured between these two components. A fabric 24, similar to fabric 20, of sufficient size, is positioned over the back side of the support 16 and the edges of the fabric 24 are wrapped over the edges of the support 16, and preferably pulled tight. The fabric 24 and canvas 10, at the edges of the unstitched area 14, are then attached such as by gluing, sewing, or other methods. The fabric can alternatively or additionally be attached to the support 16. Thus, this multilayered piece 15 comprises the canvas 10 as the outermost front layer, the padding 18 as an intermediate layer, the support 16 as another intermediate layer (behind the padding 18) and the fabric 24 as the outermost back layer. As explained above, the diameter (or length depending on the shape) of the padding 18 and support 16 can be the same or different, e.g., the support 16 can have a longer length as shown in FIG. 9). The thicknesses and or shapes of the padding 18 and support 16 can be similar or different.

The next (fourth) step of FIG. 10, which is optional, is like the step in FIG. 8 wherein a cording 22 can be added to hide the region where the fabric 24 and canvas 10 are joined to provide a smoother more finished look. The cording 22 can wrapped around the entire product and attached by glue, by sewing onto the fabric 20 and canvas 10, or by other methods. A ribbon, string, lace, etc. 25 can be attached to the cording 22 as shown in FIG. 10, or the cording itself can have a loop, for tying the finished product to another item as in ribbon 23 of FIG. 8.

FIGS. 11 and 12 provide two examples of the mounted needlepoint canvas finished products made by either of the two methods of the present invention. The product of FIG. 11, which is in the form of a patch or hang tag and designated generally by reference numeral 30, has a ribbon (or string) 34 extending through two apertures 32, 33. The apertures 32, 33 can extend through the fabric and/or rigid support and are reinforced by respective grommets (or snaps) 35, 37. The grommets can be positioned in the fabric and/or support. In the product of FIG. 12, which is in the form of a patch or hang tag and designated generally by reference numeral 40, the ribbon 44 extends through a single aperture 42 which is reinforced by a grommet (or snap) 45. The ribbon 34, 44 can be tied to an item as described above such as a bag or backpack. Due to the rigidity of the support 16, the grommets or snaps can be utilized to preserve the opening and better protect the ribbon. The ribbon or string can extend through the support 16. Cording 36, 46, connected as described in the methods above, conceals the underlying layers and attachment points.

The grommets can be used in several different ways. In one version, the grommet is placed in the fabric to prevent it from fraying. In this version, two spaced apart holes are cut through the support and the ribbon or string extends through one grommet in the fabric, through one of the holes in the support, extends across the back of the support, through the other hole in the support and lastly through the other grommet in the fabric. FIG. 11 shows an example of the ribbon extending through the two grommets 35, 37 in the fabric. (The openings in the support 16 are not visible since the support 16 is covered by the fabric 20). Due to the thickness of the support, it has additional strength so it can stay flat when the ribbon is threaded through the openings, thus facilitating the process. (Note a button hole or snap could also be used instead of the grommet). Also note the grommet(s) can be positioned in the rigid support.

In another version, the grommet is used in a more decorative fashion. Standard grommets do not have sufficient height (depth/thickness) to extend through all the layers of the product. Thus, in this version, cutouts are made through the support (i.e., portions of the support are removed) so that the fabric and canvas can be placed together in apposition so the grommet can attach to both the canvas and fabric. The ribbon or string is then inserted through the grommet and opening (cutout) and emerges from the opposing side of the multilayered piece. FIG. 12 shows an example of the finished product with such decorative grommet. The rigidity of the support enables formation of such cutouts/removed portions without adversely affecting the strength of the support, in contrast to paper based products.

As can be appreciated, with the support 16, the finished product of the embodiments disclosed herein, is more rigid as the support restricts bending. The support 16 also has the non-degradation advantages over paper based products as described above, and thus the integrity of the finished product is maintained. Due to its non-paper based composition, the finished product with the support of the present invention can be utilized for outdoor use such as outdoor signs and in humid environments.

Figure 13:
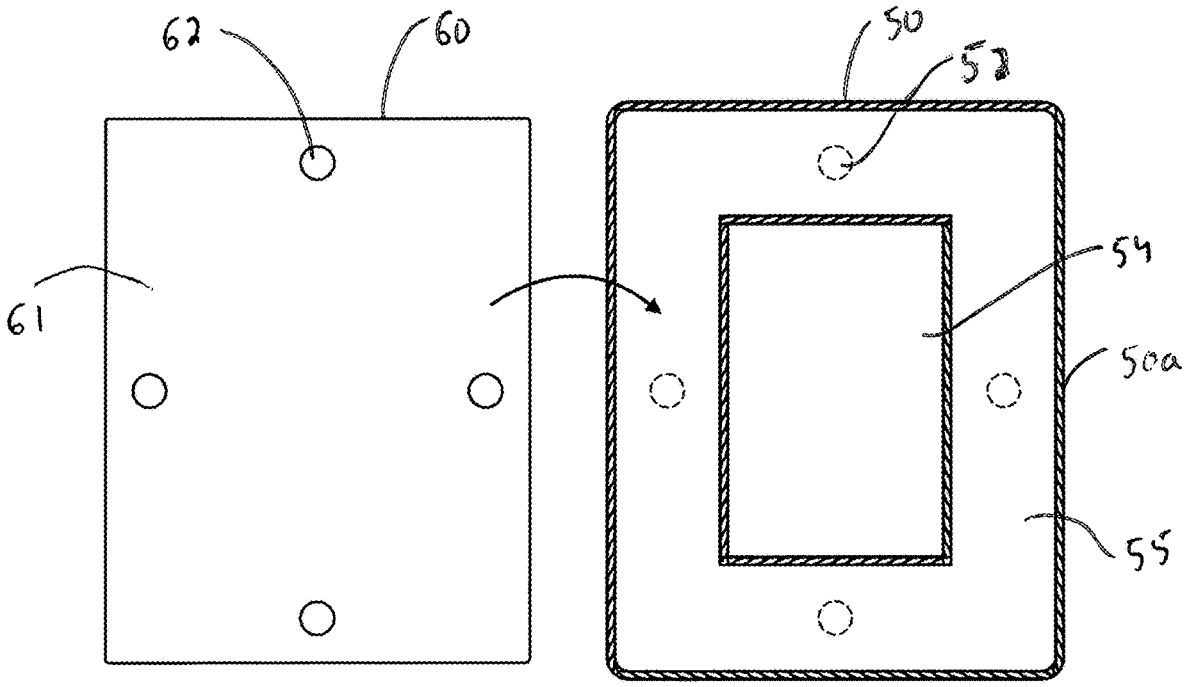
FIG. 13 is a rear view of the frame and front view of a backing of the present invention prior to attachment of the backing, the frame having magnets embedded therein and the backing having external magnets.
Figure 14:
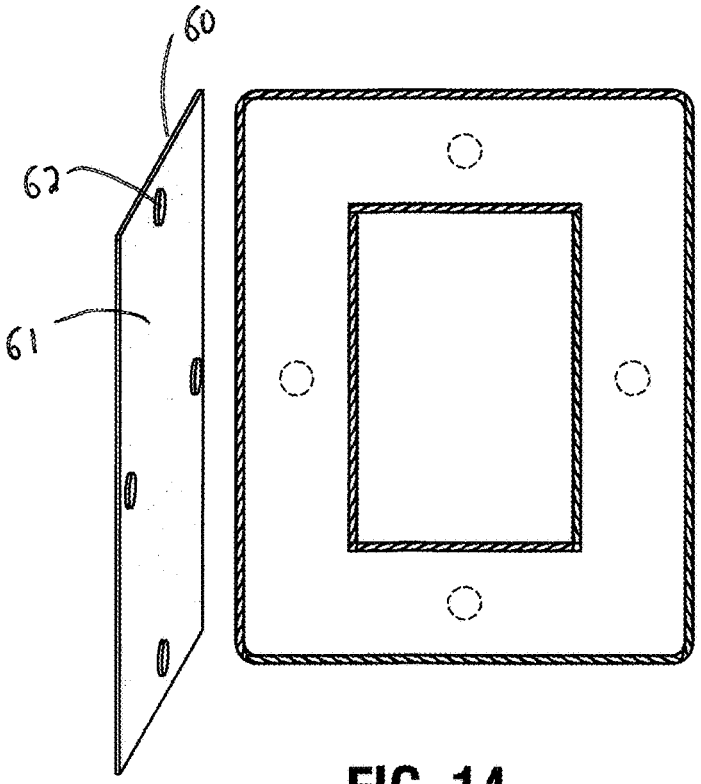
FIG. 14 is a side view showing the backing being attached to the frame of FIG. 13.
Figure 15:
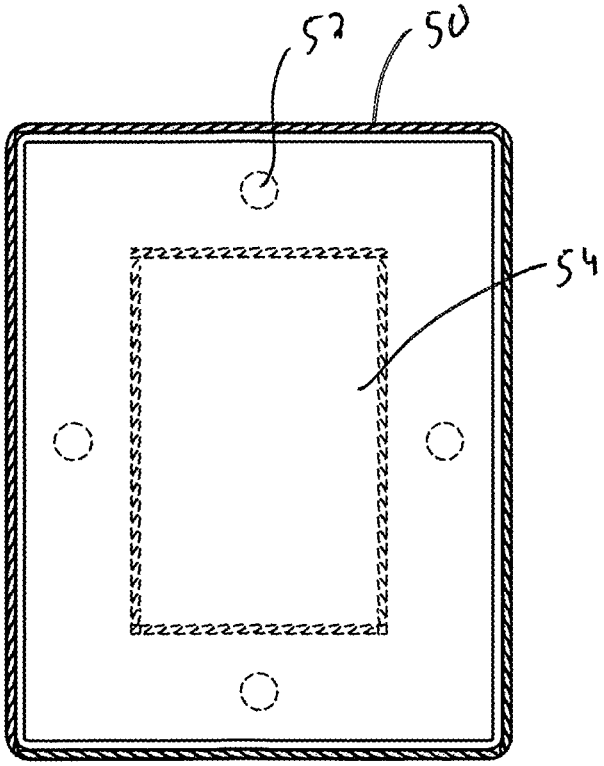
FIG. 15 is a front view of the frame of FIG. 13 with the backing attached thereto.

FIGS. 13-15 illustrate an alternate embodiment of the present invention wherein the finished product is in the form of a picture frame and includes one or more magnets. Although shown in the form of a picture frame, it should be appreciated that magnets could be incorporated into the process for other finished products disclosed herein. That is, the magnets can be incorporated into other needlepoint finished products which are made utilizing the methods disclosed herein which incorporate a rigid support as well as incorporated into other needlepoint finished products produced by conventional methods/processes.

With initial reference to FIG. 13, the frame is designated generally by reference numeral 50 and has a periphery 50*a* defining an interior stitched canvas region and an opening 54 in a central region. (The stitched canvas being between the periphery 50 and opening 54). The frame 13 is formed by any of the methods disclosed above and includes a rigid support and in some embodiments a padding between the support and canvas or between the support and fabric.

Incorporated into support behind the stitched region are one or more magnets 52. In the illustrated embodiment, four magnets are provided placed at 12 o'clock, 3 o'clock, 6 o'clock and 9 o'clock positions. It should be appreciated that other arrangements of the four magnets are contemplated. Also, fewer than four magnets or greater than four magnets can be provided. The magnets 52 can be embedded in the support as shown in phantom in FIG. 13, proximal of the canvas 56, however, in alternate embodiments, the magnets 52 can be external and extend from the back surface of the rigid support, e.g., extending proximally therefrom. As used herein, the term "distal" refers to closer to the front of the product (facing the viewer) and term "proximal" refers to further from the front of the product (facing away from the viewer). These terms are used for convenience and ease of explanation and reflect the rear facing orientation of FIG. 15.

A backing 60 is attached to the frame as shown in FIGS. 14 and 15. The backing can be made of a rigid material or a flexible material. Plastic or metallic materials or a combination of a plastic and metallic materials, are contemplated. The backing 60 is designed to support a plurality of magnets for cooperation/magnetic attraction with the magnets of the frame 50.

In the illustrated embodiment, the backing 60 includes four magnets 62 placed at 12 o'clock, 3 o'clock, 6 o'clock and 9 o'clock positions to align with the magnets 52 of the frame 50. It should be appreciated that other arrangements of the four magnets are contemplated. Also, fewer than four magnets or greater than four magnets can be provided. The magnets 52 are shown extending from the back surface 61 of the frame, however, in alternate embodiments, the magnets 62 can be embedded in the backing 60. Magnets of different sizes, number and configurations than magnets 52 and 62 are also contemplated.

When the backing 60 is placed over the back surface 55 of the frame 50, the magnetic attraction secures the backing 60 to the back surface 55 of frame 50. This is shown in FIG. 15. FIG. 14 shows the backing 60 prior to placement over the back surface 55 of the frame 50. The magnets provide an easy way to attach the backing to the frame to support a picture contained within the finished product. It also in some embodiments provides a surface for attachment of a stand as described in embodiments below.

Figure 16A:
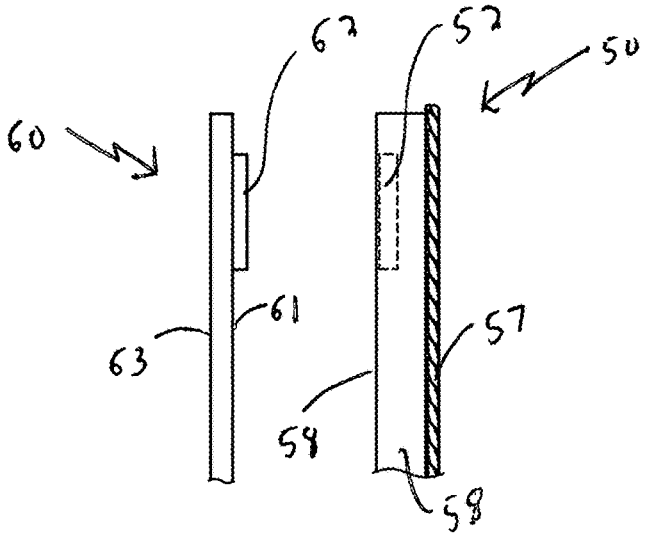
FIG. 16A is a side view of a portion of the frame and backing of FIG. 13, one magnet shown embedded in the frame and one magnet show exterior (external) to the backing.

FIG. 16A illustrates in a side view the external magnet 62 of backing 60 extending in a direction (distally) toward the embedded magnet 52 within support 58 of the finished frame 50. More specifically, the stitched canvas 57 has a rigid support 58 as described above and the magnet 52 is embedded in the rigid support 58. Thus, in the processing/method steps of the present invention disclosed herein, the rigid support would be formed with the embedded magnets. Note FIG. 16A shows only a portion of the frame 50 and backing 60 to show only one of the magnets 62 and 52 which secures the backing 60 to frame 50. It should be appreciated that the frame 50 can also have the padding and fabric as in the aforedescribed embodiments, but is not shown in FIG. 16A in order to illustrate a simplified version of the magnetic connection.

Figure 16B:
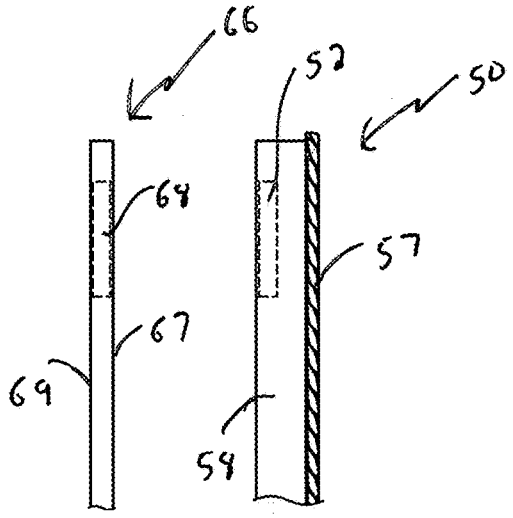
FIG. 16B is a side view of an alternate embodiment of the backing of the present invention having magnets embedded therein.

FIG. 16B illustrates an alternate embodiment where the backing 66 has a magnet 67 embedded therein between front wall 67 and back wall 69 rather than an external magnet as in the embodiment of FIG. 16A. The backing 66 is attached to the back surface 55 of frame 50 wherein magnet 68 aligns with magnet 52. Note FIG. 16B shows only a portion of the frame 50 and backing 66 to show only one of the magnets 67 and 52 which secures the backing 66 to frame 50. It should be appreciated, that the frame 50 can also have the padding and fabric as in the aforedescribed embodiments, but is not shown in FIG. 16B in order to illustrate a simplified version of the magnetic connection.

Figure 17A:
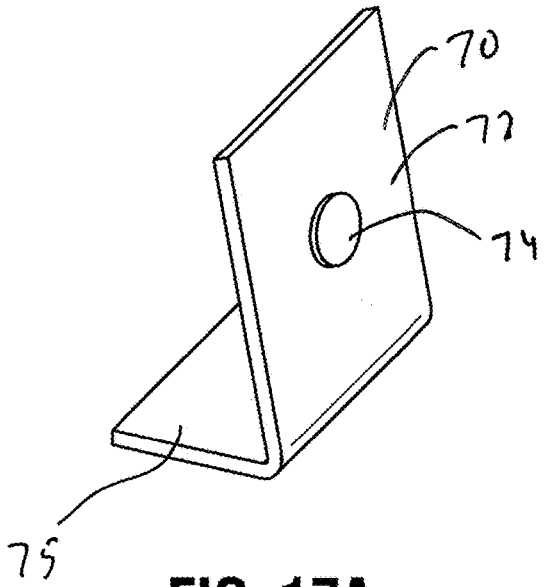
FIG. 17A is a perspective view of an embodiment of a stand (foot) of the present invention having an external magnet for attachment to the backing.
Figure 17B:
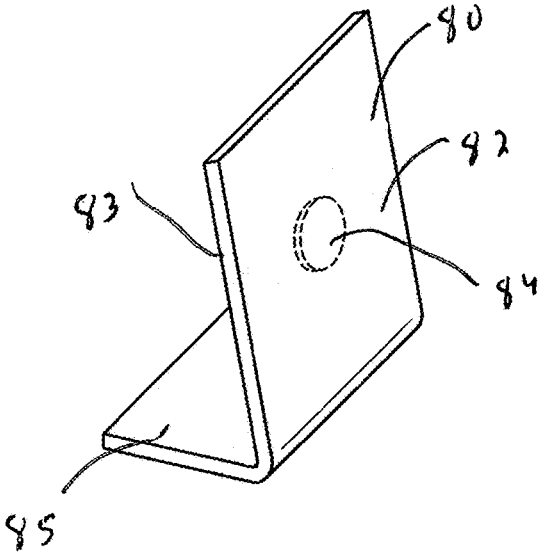
FIG. 17B is a perspective view of an alternate embodiment of the stand (foot) of the present invention having a magnet embedded therein for attachment to the backing.

In some embodiments, a foot or stand can be provided to support the frame 50 in an upright position. In the embodiment of FIG. 17A, foot or stand 70 has a magnet 74 extending distally from external (front/distal) surface/wall 72; in the embodiment of FIG. 17B, foot or stand 80 has a magnet 84 embedded therein positioned between front surface/wall 82 and back (proximal) surface/wall 83. FIG. 17B also provides an illustration of an alternate embodiment wherein the magnet 84 (shown in phantom) is attached to a back (proximal) surface/wall 83 of stand 80. The magnet 84 (and 74) can be attached by an adhesive or free floating and attached via magnetic attachment, in either case providing sufficient magnetic force to attach the stand 80 to the backing as described below.

The foot 70 or 80 is secured to the backing and is maintained in position by the magnetic attraction to a metallic material of the backing 60 or alternatively the backing can have an additional magnet embedded therein or an additional magnet extending externally proximally therefrom for magnetic attraction to magnet 74 or 84. Although one magnet 74, 84 is shown in a center region of the stand 70, 80, respectively, other locations are also contemplated. Also, other magnet configurations as well as more than one magnet are also envisioned.

Figure 18:
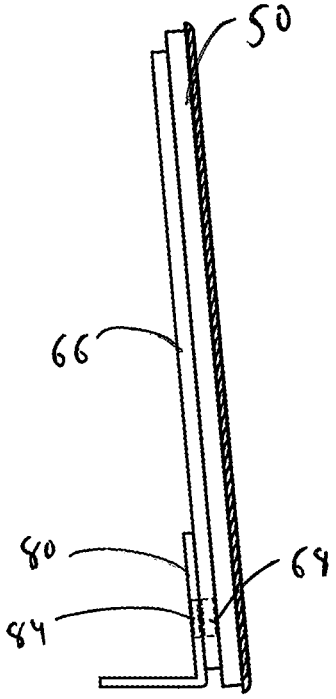
FIG. 18 is a side view showing the stand of FIG. 17B attached to the backing of FIG. 16B to hold the frame in the vertical position.
Figure 19:
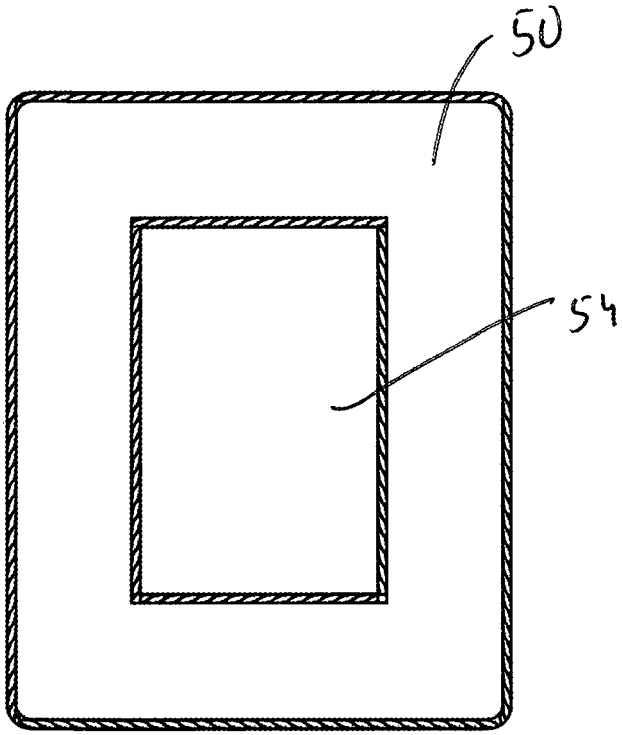
FIG. 19 is a front view of the frame of FIG. 17 held by the stand in the vertical position.
Figure 20:
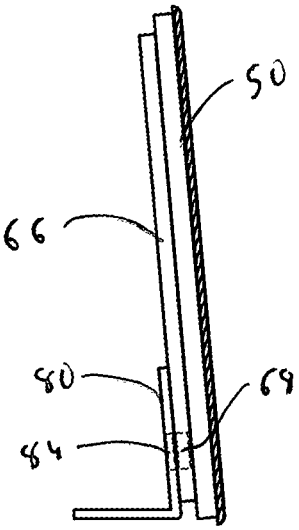
FIG. 20 is a side view showing the stand of FIG. 17B attached to the backing of FIG. 16B to hold the frame in a horizontal position.
Figure 21:
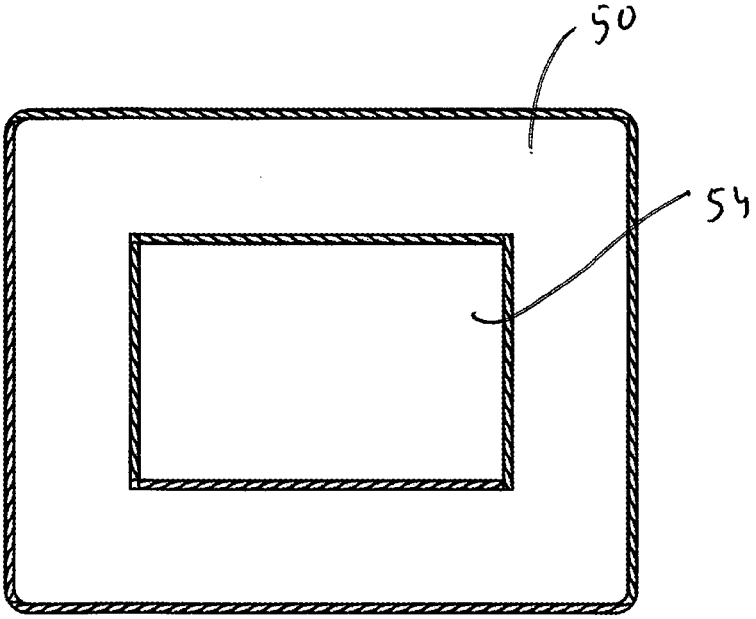
FIG. 21 is a front view of the frame of FIG. 19 held by the stand in the horizontal position.

With the magnetic attraction, the stand 70 or 80 can hold the frame 50 in a vertical or horizontal position. FIG. 18 shows the stand 80 holding the frame 50 in the vertical position of FIG. 19; FIG. 20 shows the stand 80 holding the frame 50 in the horizontal position of FIG. 21. Note stand 70 can support the frames in the positions of FIGS. 19 and 21 in the same way as stand 80. Note due to the magnetic securement, the frame 50 can also be held in diagonal orientations.

Figure 22:
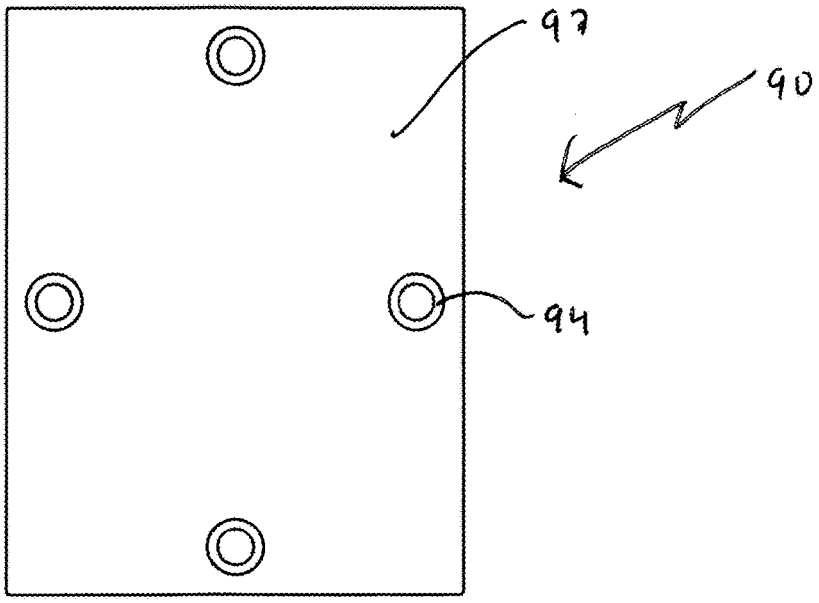
FIG. 22 is a front view of an alternate embodiment of the backing of the present invention having a series of washers extending from an external surface.

FIG. 22 illustrates an alternate embodiment of the backing. Backing 90 has a series of washers 94 (instead of magnets), spaced apart at 12 o'clock, 3 o'clock, 6 o'clock and 9 o'clock positions for magnetic attraction to the magnets of the frame 50, thereby securing the backing 90 to the frame 50. The washers 94 are positioned to correspond/align with the magnets 52 of the frame 50. The backing can be made of a plastic or material without magnetic attraction.

Figure 23:
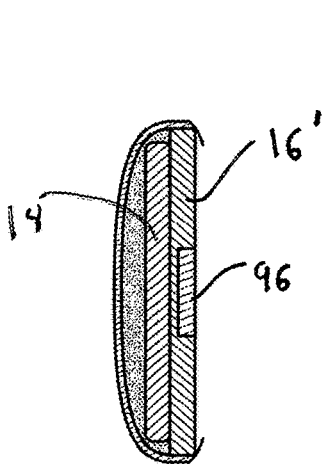
FIG. 23 is a cross-sectional view of the embodiment of FIG. 4 having a magnet embedded in the rigid support.
Figure 24:
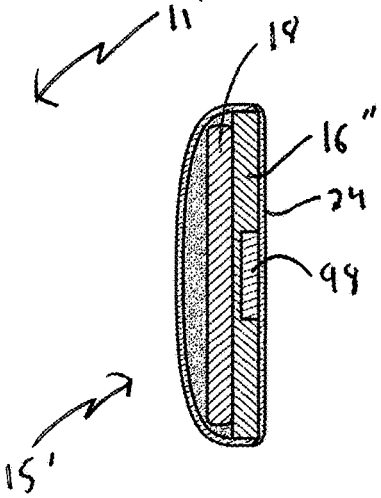
FIG. 24 is a cross-sectional view of the embodiment of FIG. 8 having a magnet embedded in the rigid support.

FIG. 23 illustrates the needlepoint finishing method of FIG. 4 with the addition of magnet 96 in the support 16'. Support 16' is otherwise identical to support 16 of FIG. 4. The other components of FIG. 23 (e.g., padding 18) are also identical to those of FIG. 4. FIG. 24 illustrates the needlepoint finishing method of FIG. 9 with the addition of magnet 98 in the support 16". Support 16" is otherwise identical to support 16 of FIG. 9. The other components of FIG. 24 are also identical to those of FIG. 9.

Figure 25:
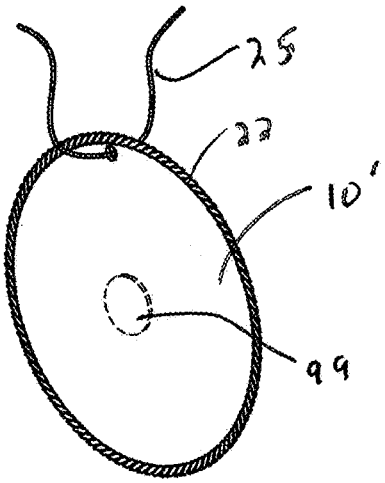
FIG. 25 is a perspective view showing an embodiment of the finished product of FIG. 10 having a magnet for mounting.

The ornament/finished product of FIG. 10 can also include a magnet as shown in FIG. 25. More specifically, magnet 99 is embedded in the support 16 or externally attached to the support 16 of product 10'.

Although the apparatus and methods of the subject invention have been described with respect to preferred embodiments, those skilled in the art will readily appreciate that changes and modifications may be made thereto without departing from the spirit and scope of the present invention as defined by the appended claims. Persons skilled in the art will understand that the various embodiments of the disclosure described herein and shown in the accompanying figures constitute non-limiting examples, and that additional components and features may be added to any of the embodiments discussed herein without departing from the scope of the present disclosure.

It will be understood by those skilled in the art that the above particular embodiments are shown and described by way of illustration only. The principles and the features of the present disclosure may be employed in various and numerous embodiments thereof without departing from the scope and spirit of the disclosure. The above-described embodiments do not restrict the scope of the disclosure.

Additionally, persons skilled in the art will understand that the elements and features shown or described in connection with one embodiment may be combined with those of another embodiment without departing from the scope of the present invention and will appreciate further features and advantages of the presently disclosed subject matter based on the description provided.

Throughout the present disclosure, terms such as "approximately," "about", "generally," "substantially," and the like should be understood to allow for variations in any numerical range or concept with which they are associated. It is intended that the use of terms such as "approximately", "about", "substantially", and "generally" should be understood to encompass variations on the order of 25%, or to allow for manufacturing tolerances and/or deviations in design.

Although terms such as "first," "second," "third," etc., may be used herein to describe various operations, elements, components, regions, and/or sections, these operations, elements, components, regions, and/or sections should not be limited by the use of these terms in that these terms are used to distinguish one operation, element, component, region, or section from another. Thus, unless expressly stated otherwise, a first operation, element, component, region, or section could be termed a second operation, element, component, region, or section without departing from the scope of the present invention.

Also, the phrases "at least one of A, B, and C" and "A and/or B and/or C" should each be interpreted to include only A, only B, only C, or any combination of A, B, and C.

What is claimed is:

1. A method for needlepoint finishing comprising:

a) trimming a canvas completed with a needlepoint stitched design leaving an edge portion spaced from a stitched area of the canvas to leave an unstitched area around at least a portion of a periphery of the canvas;

b) cutting a non-paper based rigid support for mounting of the canvas;

c) securing a first magnet in or on the rigid support either before or after cutting the rigid support in step (b);

d) placing unstitched edges of the canvas around edges of the rigid support;

e) wrapping a fabric composed of softer material than the rigid support around the support and;

f) attaching the fabric to one or both of the rigid support or the canvas.

2. The method of claim 1, further comprising positioning a padding of softer material than the rigid support between the stitched area of the canvas and the rigid support to position the padding between the stitched area of the canvas and the rigid support.

3. The method of claim 1, wherein the size of a rigid support is less than a size of the canvas.

4. The method of claim 1, wherein the canvas forms a frame defining a periphery and an opening inside the periphery for viewing of a picture.

5. The method of claim 1, further comprising a backing having a second magnet, the second magnet of the backing in alignment with the first magnet of the support to attack the backing to the support.

6. The method of claim 5, wherein the backing and the support each have multiple magnets, each of the multiple magnets of the backing in alignment with one of the magnets of the support.

7. The method of claim 5, further comprising a stand having a magnet for securing the stand to a rear portion of the backing.

8. The method of claim 1, further comprising a backing, wherein at least a portion of the backing is composed of a metallic material to secure the backing to the support via the first magnet.

9. The method of claim 1, further comprising a backing, wherein the backing includes a metallic component to secure the backing to the support via the first magnet.

10. The method of claim 1, wherein the rigid support is composed of a substantially non-absorbent material to limit retention of moisture and degradation of integrity of the rigid support and stitched canvas.

11. A method for needlepoint finishing comprising:

a) trimming a canvas completed with a needlepoint stitched design leaving an edge portion spaced from a stitched area of the canvas to leave an unstitched area around at least a portion of a periphery of the canvas;

b) cutting a non-paper based first rigid support for mounting of the canvas;

c) wrapping the canvas around at least edges of the first rigid support to form a first multilayered piece comprising the canvas and first rigid support;

d) wrapping a fabric around a second rigid support to form a second multilayered piece comprising the fabric and second rigid support, the fabric composed of softer material than the first rigid support;

e) placing the first and second multilayered pieces in apposition; and f) attaching the first and second multi-layered pieces such that the first and second rigid supports restrict bending of the canvas;

g) wherein one or both of the first and second rigid supports includes a magnet.

12. The method of claim 11, further comprising one or both of a) a first padding positioned in the first multilayered piece between the first rigid support and canvas; and b) a second padding positioned in the second multilayered piece between the second rigid support and fabric.

13. The method of claim 11, further comprising a backing having a second magnet, the second magnet of the backing in alignment with the magnet of the first or second support to attach the backing to the first or second support.

14. The method of claim 13, further comprising a stand having a magnet, the magnet of the stand configured to secure the stand to a back portion of the backing.

15. A multilayered finished needlepoint product comprising:

a) a stitched needlepoint canvas having a front side and a back side b) a first support having a front side and an opposing back side, the front side facing the canvas, the first support having a surface area in the front side less than a surface area of the front side of the canvas, the canvas mounted to the first support, wherein the first support has a first magnet; and c) a backing having a second magnet, the second magnet of the backing in alignment with the first magnet of the support to secure the backing to the support;

d) wherein the first support is formed from a non-paper based rigid material to restrict bending of the mounted canvas.

16. The finished needlepoint product of claim 15, further comprising a padding positioned between the canvas and first support.

17. The finished needlepoint product of claim 15, wherein the needlepoint canvas forms a frame, and further comprising a stand having a magnet configured to secure the stand to a back portion of the backing.

18. The finished needlepoint product of claim 15, wherein the backing and the support each have multiple magnets, each of the multiple magnets of the backing in alignment with one of the magnets of the support.

* * * * *